US006378448B1

(12) United States Patent
Hunang

(10) Patent No.: US 6,378,448 B1
(45) Date of Patent: Apr. 30, 2002

(54) THREAD CUTTING DEVICE FOR A SEWING MACHINE

(75) Inventor: Chun-Zen Hunang, No. 27, Lane 462, Ta-Chang 2nd Rd., San-Min Dist., Kaohsiung City (TW)

(73) Assignee: Chun-Zen Hunang, Kaohsiung (TW)

( * ) Notice: Subject to any disclaimer, the term of this patent is extended or adjusted under 35 U.S.C. 154(b) by 0 days.

(21) Appl. No.: 09/702,232

(22) Filed: Oct. 31, 2000

(51) Int. Cl.[7] ..... D05B 65/00
(52) U.S. Cl. ..... 112/298
(58) Field of Search ..... 112/296, 298, 112/292, 285, 288, 291, 293, 300, 295

(56) References Cited

U.S. PATENT DOCUMENTS 5,887,535 A 3/1999 Yu ..... 112/298
6,205,941 B1 * 3/2001 Yu ..... 112/286
6,234,097 B1 * 5/2001 Ku ..... 112/298

* cited by examiner

*Primary Examiner*—Peter Nerbun
(74) *Attorney, Agent, or Firm*—Ohlandt, Greeley, Ruggiero & Perle, L.L.P.

(57) ABSTRACT

A thread cutting device for a sewing machine includes a front pivot member and a rear pivot member which extend through an elongated cutting plate and an elongated swing plate that is disposed between the cutting plate and a base plate. A driving rod is mounted swingably on the base plate, and has an end that is received slidably within a transverse slide slot in the cutting plate. When the driving rod is swung by a driving unit, the cutting plate and the swing plate rotate to align a cutter of the cutting plate with a needle. Then, the cutting plate is guided to move toward the needle relative to the swing plate. Each of the front and rear pivot members includes an eccentric wheel element that is formed with a threaded hole and that is rotatable relative to the cutting plate and the swing plate, and a bolt that extends threadably through the threaded hole in the eccentric wheel element to engage a threaded hole in the base plate.

3 Claims, 5 Drawing Sheets

THREAD CUTTING DEVICE FOR A SEWING MACHINE

BACKGROUND OF THE INVENTION

1. Field of the Invention

This invention relates to a sewing machine, more particularly to a thread cutting device for a sewing machine.

2. Description of the Related Art

In U.S. Pat. No. 5,887,535, there is disclosed a thread cutting device for a sewing machine that includes a base plate, a feed plate, a cutting plate, a driving rod, a driving unit, a crank, a torsion spring, and a reed spring. Although the thread cutting device can cut effectively a row of threads, it has a relatively complicated structure. As a result, it is difficult to adjust the positions of some movable elements of the thread cutting device relative to the threads to be cut. Furthermore, each of the feed plate and the cutting plate has a path of travel which is relatively long, thereby resulting in a relatively large amount of noise during operation thereof.

SUMMARY OF THE INVENTION

The object of this invention is to provide a thread cutting device for a sewing machine which has advantages of simple structure, convenient position adjustment, short paths of travel of movable elements, and reduced amount of noise.

According to this invention, a thread cutting device for a sewing machine includes a front pivot member and a rear pivot member which extend through an elongated cutting plate and an elongated swing plate that is disposed between the cutting plate and a base plate. A driving rod is mounted swingably on the base plate, and has an end that is received slidably within a transverse slide slot in the cutting plate. When the driving rod is swung by a driving unit, the cutting plate and the swing plate rotate to align a cutter of the cutting plate with a needle. Then, the cutting plate is guided to move toward the needle relative to the swing plate. Accordingly, the paths of travel of the cutting plate and the swing plate are relatively short, thereby reducing noise resulting from the operation thereof. Each of the front and rear pivot members includes an eccentric wheel element that is formed with a threaded hole and that is rotatable relative to the cutting plate and the swing plate, and a bolt that extends threadably through the threaded hole in the eccentric wheel element to engage a threaded hole in the base plate. In a case where the cutter cannot be brought into alignment with the threads to be cut, as long as the eccentric wheel elements are rotated on the base plate, the cutter can come into alignment with the threads. Thus, the position adjustment of the cutting plate and the swing plate can be performed easily.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
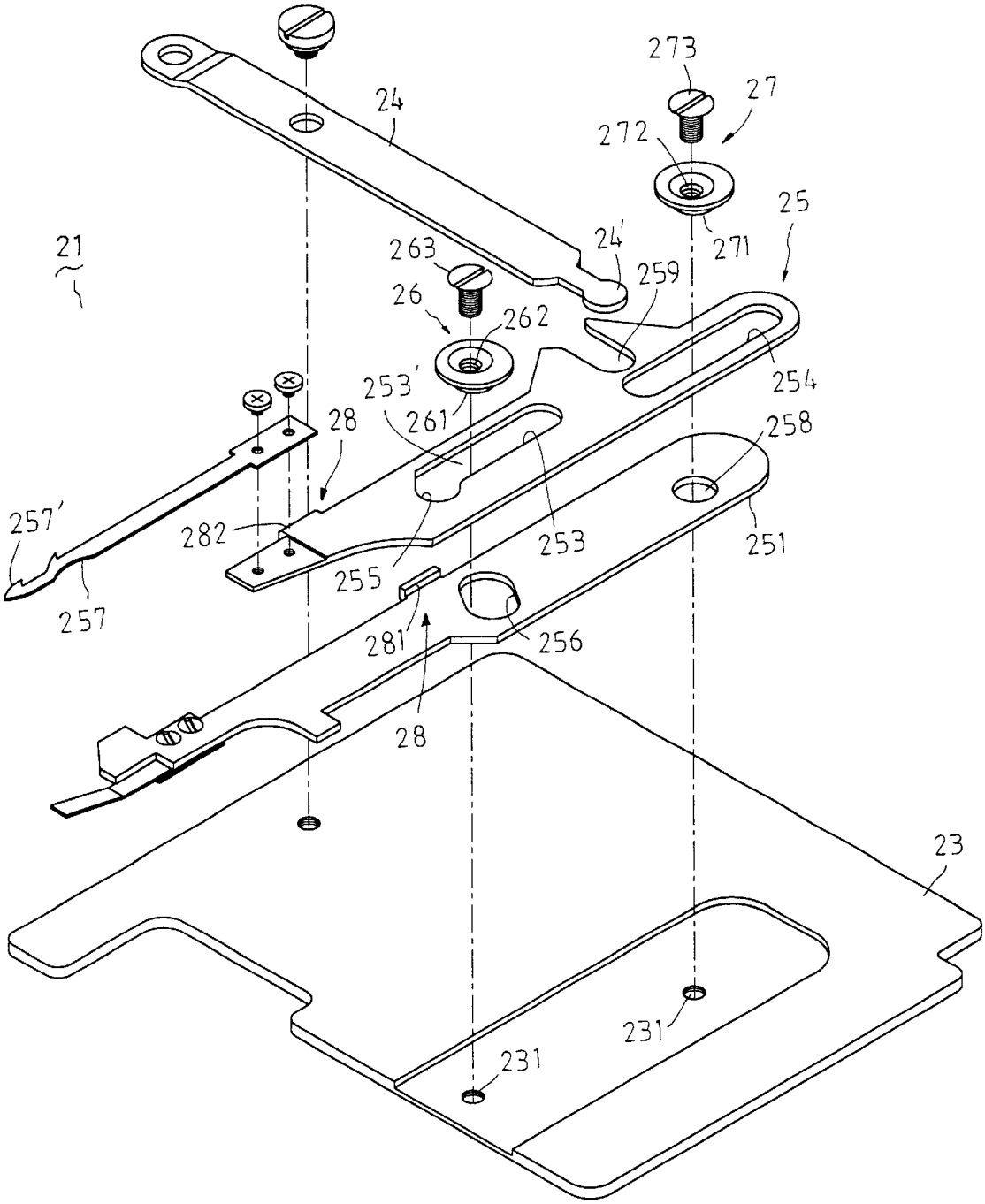
FIG. 1 is an exploded view of the preferred embodiment of a thread cutting device for a sewing machine according to this invention.
Figure 2:
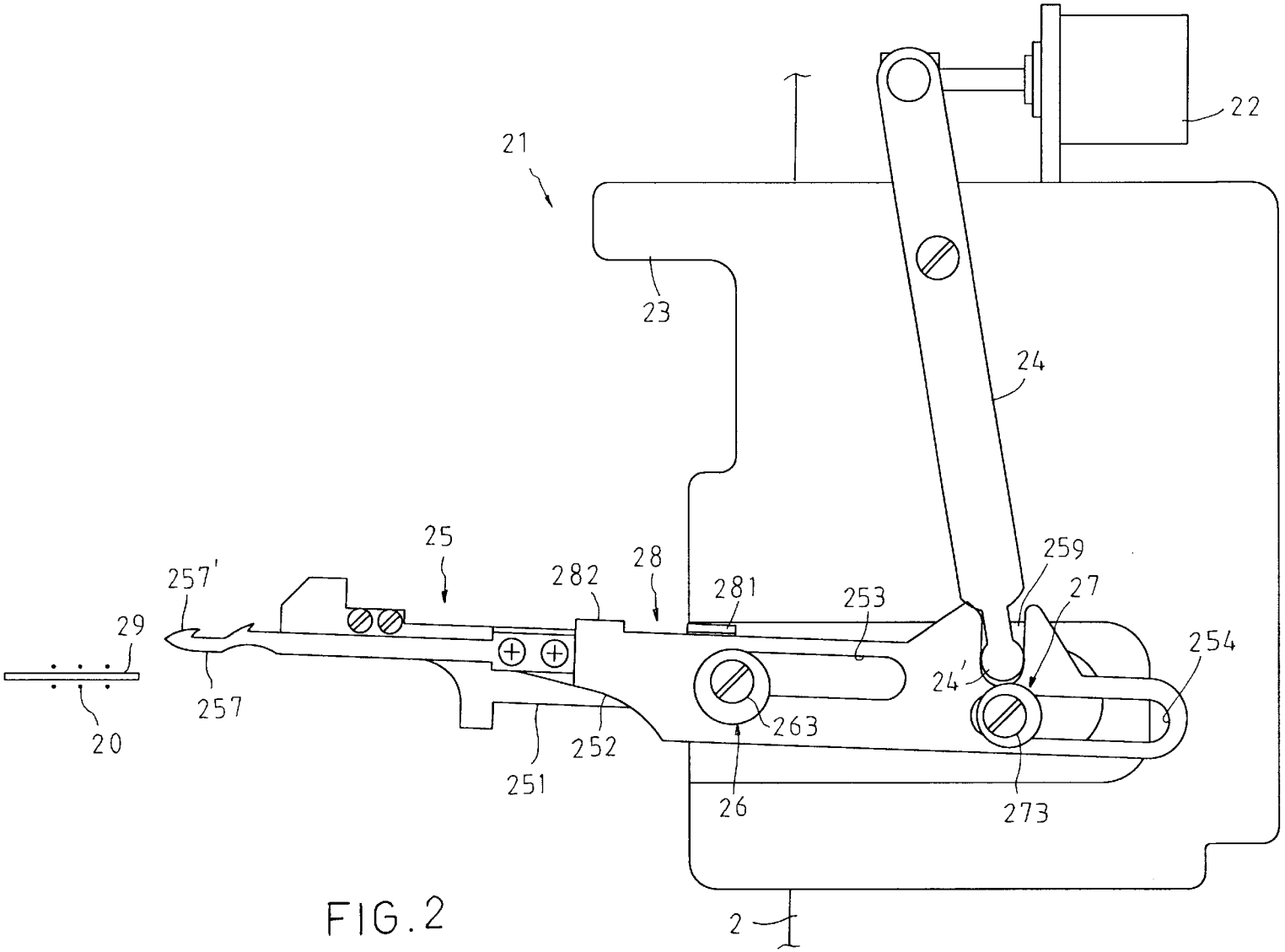
FIG. 2 is a schematic top view of the preferred embodiment, illustrating a rear limit position of a rounded end of a driving rod.

Referring to FIGS. 1 and 2, the preferred embodiment of a thread cutting device 21 for a sewing machine is shown to include a driving unit 22, a horizontal base plate 23, a driving rod 24, an elongated horizontal swing plate 251, and an elongated horizontal cutting plate 252. The sewing machine is provided with a horizontal thread-engaging needle 29, which is in front of the thread cutting device 21. The thread cutting device 21 is adapted to cut a row of threads 20 which are located on one side of the needle 29.

The swing plate 251 is disposed on and above the base plate 23, and has a pivot hole 258 formed through a rear portion thereof, and an inclined slide slot 256 that is formed through the swing plate 251 and that is in front of the pivot hole 258. The inclined slide slot 256 extends in a direction that is inclined with respect to longitudinal and transverse directions of the swing plate 251. A flange 281 extends integrally and laterally from a side of the swing plate 251, and abuts against a side of the cutting plate 252.

The cutting plate 252 is disposed slidably on and above the swing plate 251, and includes a front slide slot 253, a rear slide slot 254, a cutter 257, and an open-ended transverse slide slot 259. The front slide slot 253 is formed through an intermediate portion of the cutting plate 252, and has a longitudinal rear portion 253' that extends in a longitudinal direction of the cutting plate 252, and an inclined front portion 255 which extends in a direction that is inclined with respect to longitudinal and transverse directions of the cutting plate 252. The rear slide slot 254 is formed through a rear end portion of the cutting plate 252, and extends in the longitudinal direction of the cutting plate 252. The cutter 257 is fixed to a front end portion of the cutting plate 252, and is formed withabarb-shaped blade portion 257'. As illustrated, each of the front and rear slide slots 253, 254 has closed front and rear ends. A flange 282 extends integrally and laterally from the side of the cutting plate 252, and abuts against the side of the swing plate 251. The flanges 281 constitute cooperatively a unit 28 for rotating the swing plate 251 and the cutting plate 252 synchronously.

A front pivot member 26 extends through the front slide slot 253 in the cutting plate 252 and the inclined slide slot 256 in the swing plate 251, and is attached threadably to the base plate 23.

A rear pivot member 27 extends through the rear slide slot 254 in the cutting plate 252 and the pivot hole 258 in the swing plate 251 so as to mount the cutting plate 252 and the swing plate 251 rotatably on the base plate 23, thereby permitting rotation of the cutting plate 252 and the swing plate 251 about the rear pivot member 27.

The driving rod 24 is mounted rotatably on the base plate 23, and has a rounded end 24', which is received slidably within the transverse slide slot 259 in the cutting plate 252. The rounded end 24' of the driving rod 24 is rotatable about a vertical axis between a front limit position shown in FIG. 4, where the blade portion of the cutter 257 is adapted to be located in front of the needle 29 and where the front and rear pivot members 26, 27 are located respectively in the rear ends of the front and rear slide slots 253, 254 in the cutting plate 252, and a rear limit position shown in FIG. 2, where the front pivot member 26 is located in the inclined front portion 255 of the front slide slot 253 in the cutting plate 252 and where the rear pivot member 27 is located in the front end of the rear slide slot 254 in the cutting plate 252.

A driving unit 22 can activate the driving rod 24 to swing on the base plate 23.

Figure 3:
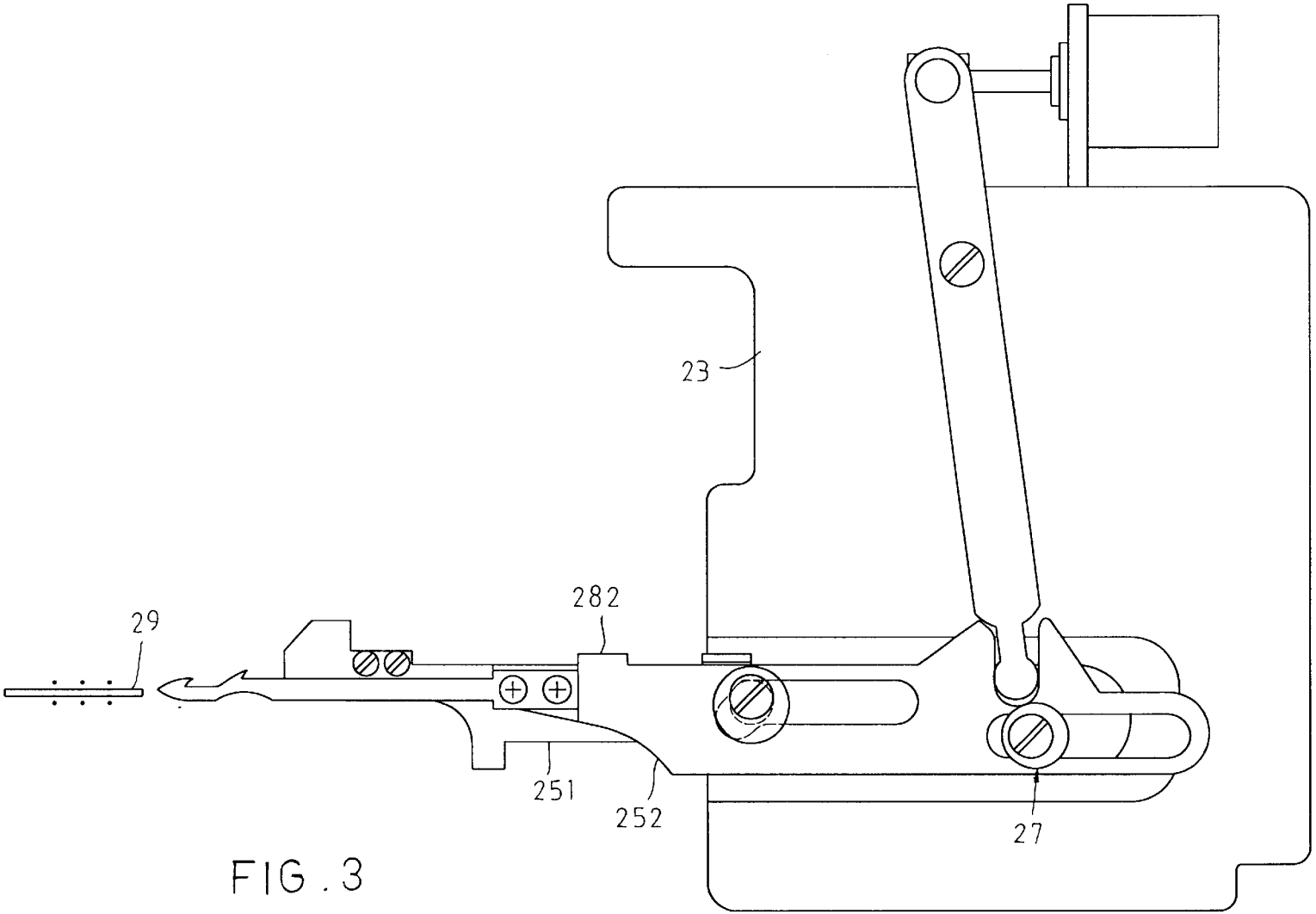
FIG. 3 is a schematic top view of the preferred embodiment, illustrating a cutter-feeding position of the rounded end of the driving rod, in which a cutter is located at a stand-by position.

When the rounded end 24' of the driving rod 24 swings on the base plate 23 from the rear limit position shown in FIG. 2 to a cutter-feeding position shown in FIG. 3, because the front pivot member 26 cannot move on the base plate 23, the cutting plate 252 rotates in a first or counterclockwise direction in such a manner that the front pivot member 26 moves from the inclined front portion 255 of the front slide slot 253 to a front end of the longitudinal rear portion 253' of the front slide slot 253, thereby preventing further counterclockwise rotation of the cutting plate 252. During counterclockwise rotation of the cutting plate 252, the flange 282 pushes the swing plate 251 to rotate synchronously therewith. When the rounded end 24' of the driving rod 24 reaches the cutter-feeding position shown in FIG. 3, the cutter 257 is disposed at a stand-by position, and is aligned with the needle 29. Under this condition, the longitudinal rear portion 253' of the front slide slot 253 and the rear slide slot 254 in the cutting plate 252 are generally parallel to the needle 29.

Figure 4:
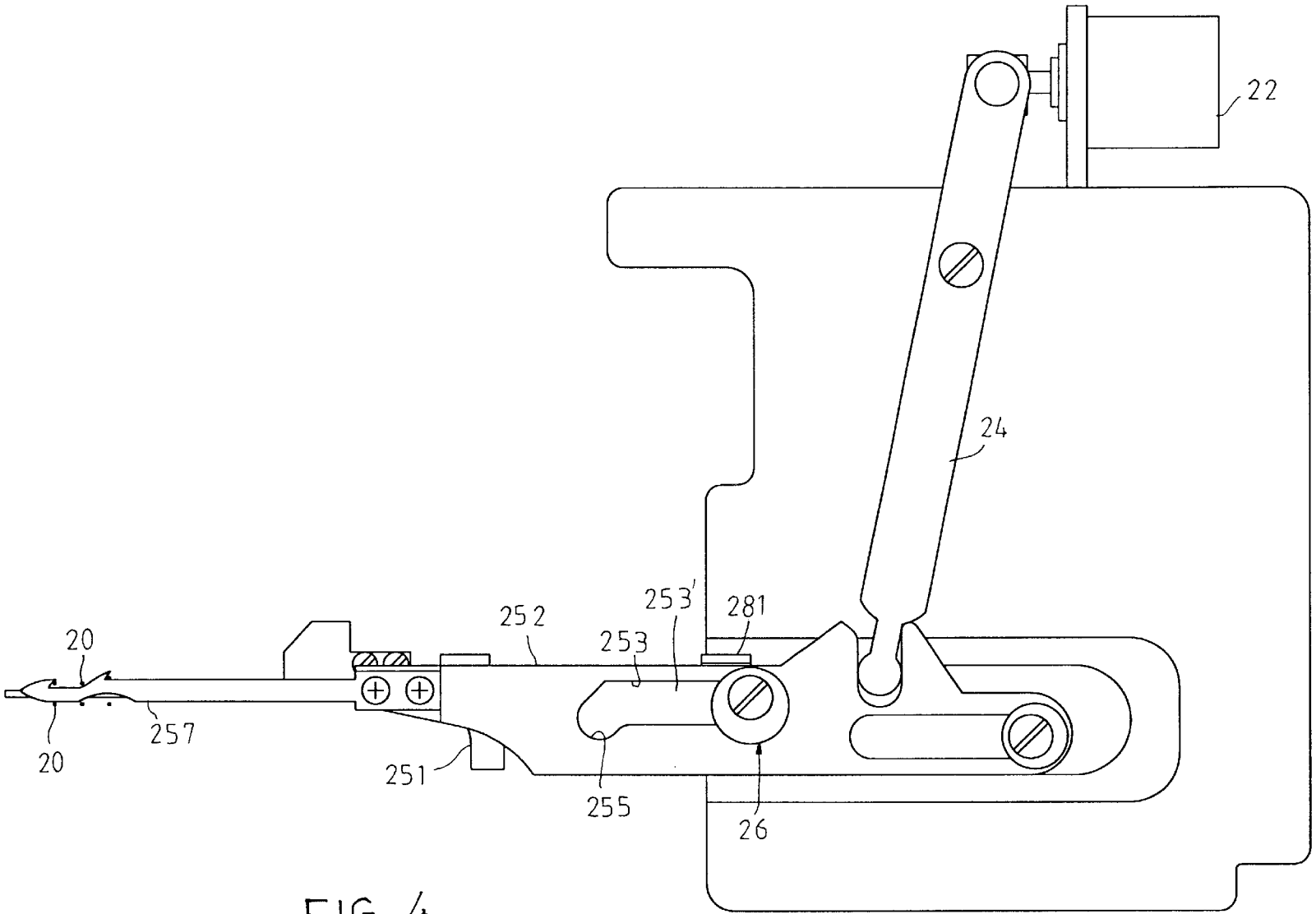
FIG. 4 is a schematic top view of the preferred embodiment, illustrating a front limit position of the rounded end of the driving rod, in which the cutter is ready for cutting a row of threads.

When the rounded end 24' of the driving rod 24 continues to swing from the cutter-feeding position shown in FIG. 3 to the front limit position shown in FIG. 4, because the rear pivot member 27 is able to move in the rear slide slot 254 in the cutting plate 252, and is unable to move in the pivot hole 258 in the swing plate 251, the cutting plate 252 moves on the swing plate 251 toward the needle 29 in such a manner that the front and rear pivot members 26, 27 move to the rear ends of the front and rear slide slots 253, 254.

When the rounded end 24' of the driving rod 24 swings from the front limit position shown in FIG. 4 to the rear limit position shown in FIG. 2, each of the elements of the thread cutting device 21 returns to the original position shown in FIG. 2 via the same path.

Because the blade portion 257' of the cutter 257 is located in front of the row of threads 29 to be cut when the rounded end 24' of the driving rod 24 is located at the front limit position shown in FIG. 4, rearward swinging movement of the rounded end 24' of the driving rod 24 from the front limit position results in cutting of the row of threads 29 by the cutter 257.

When the rounded end 24' of the driving rod 24 swings rearward from the cutter-feeding position shown in FIG. 3 to the front limit position shown in FIG. 2, the cutting plate 252 rotates in a second or clockwise direction due to sliding movement of the front pivot member 26 within the inclined front portion 255 of the front slide slot 253 in the cutting plate 252, and pushes the flange 281 of the swing plate 251 to rotate synchronously therewith.

Figure 5:
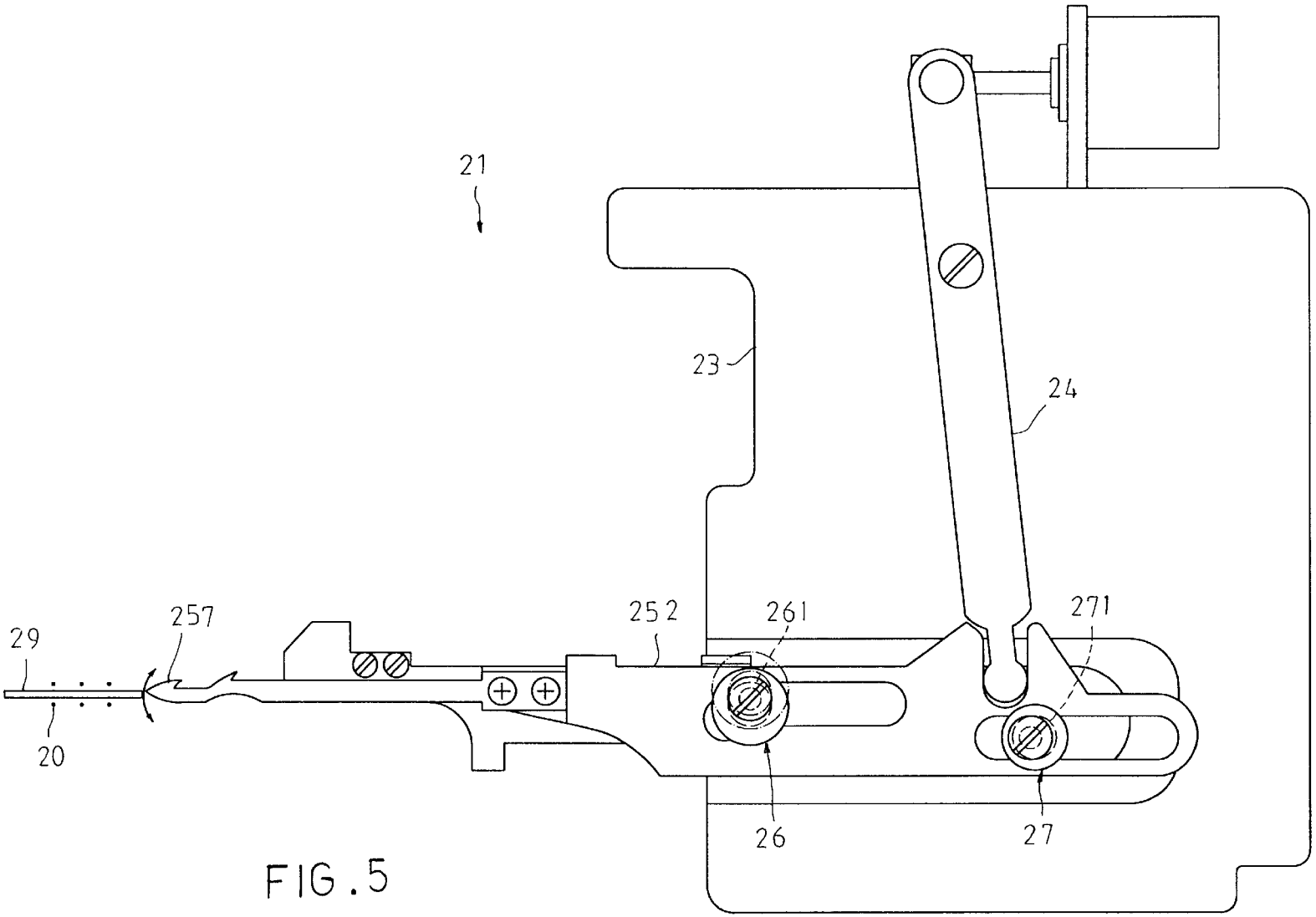
FIG. 5 is a schematic top view of the preferred embodiment, illustrating how the positions of a cutting plate and a swing plate are adjusted relative to a base plate.

The base plate 23 is formed with two threaded holes 231. Each of the front and rear pivot members 26, 27 includes an eccentric wheel element 261, 271 that is formed with a threaded hole 262, 272 therethrough, and a bolt 263, 273 that extends threadably and eccentrically through the threaded hole 262, 272 in the eccentric wheel element 261, 271 to engage the respective threaded hole 231 in the base plate 23. As illustrated, the eccentric wheel element 261 of the front pivot member 26 is received rotatably within the front slide slot 253 in the cutting plate 252 and the inclined slide slot 256 in the swing plate 251. The eccentric wheel element 271 of the rear pivot member 27 is received rotatably within the rear slide slot 254 in the cutting plate 252 and the pivot hole 258 in the swing plate 251. As such, when it is found that the cutter 257 cannot be brought into alignment with the needle 29, the positions of the cutting plate 252 can be adjusted relative to the base plate 23 by rotating either of the eccentric wheel elements 261, 271 about the respective bolt 263, 273, e.g. from the positions shown by the phantom lines in FIG. 5 to those shown by the solid lines in FIG. 5. A smaller amount of position adjustment to the cutting plate 252 can be performed by rotating the eccentric wheel element 261 of the front pivot member 26, while a greater amount of position adjustment to the cutting plate 252 can be performed by rotating the eccentric wheel element 271 of the rear pivot member 27.

This invention has the following advantages:

(1) Because the number of the parts of the thread cutting device is relatively small, the manufacturing costs are reduced.

(2) The positions of the swing plate 251 and the cutting plate 252 can be adjusted easily relative to the base plate 23 by rotating the eccentric wheel elements 261, 271.

(3) Before the cutter 257 is fed toward the threads 20 to be cut, the swing plate 251 and the cutting plate 252 are rotated by only a relatively small angle. Accordingly, during operation, the noise resulting from the operation of the swing plate 251 and the cutting plate 252 can be reduced.

With this invention thus explained, it is apparent that numerous modifications and variations can be made without departing from the scope and spirit of this invention. It is therefore intended that this invention be limited only as indicated in the appended claims.

I claim:

1. A thread cutting device for a sewing machine, the sewing machine including a horizontal thread-engaging needle, which is in front of said thread cutting device, said thread cutting device being adapted to cut a row of threads, which are located on one side of the needle, and comprising:

a horizontal base plate;

an elongated horizontal swing plate disposed on and above said base plate and having a pivot hole formed through a rear end portion thereof, and an inclined slide slot which is formed through said swing plate and in front of said pivot hole and which extends in a direction that is inclined with respect to longitudinal and transverse directions of said swing plate;

an elongated horizontal cutting plate disposed slidably on and above said swing plate and including a cutter that is fixed to a front end thereof and that is formed with a barb-shaped blade portion, an open-ended transverse slide slot, a front slide slot that is formed through an intermediate portion of said cutting plate, and a rear slide slot that is formed through a rear end portion of said cutting plate and that extends in a longitudinal direction of said cutting plate, said front slide slot having a longitudinal rear portion that extends in the longitudinal direction of said cutting plate and an inclined front portion that extends in a direction that is inclined with respect to the longitudinal direction and a transverse direction of said cutting plate, each of said front and rear slide slots having closed front and rear ends;

a front pivot member extending through said front slide slot in said cutting plate and said inclined slide slot in said swing plate and attached to said base plate;

a rear pivot member extending through said rear slide slot in said cutting plate and said pivot hole in said swing plate so as to mount said cutting plate and said swing plate rotatably on said base plate, thereby permitting rotation of said cutting plate and said swing plate about said rear pivot member;

a driving rod mounted pivotally on said base plate and having a rounded end, which is received slidably within said transverse slide slot in said cutting plate, said rounded end of said driving rod being rotatable about a vertical axis between a front limit position, where said blade portion of said cutter is adapted to be located in front of the needle and where said front and rear pivot members are located respectively in said rear ends of said front and rear slide slots in said cutting plate, and a rear limit position, where said front pivot member is located in said inclined front portion of said front slide slot and where said rear pivot member is located in said front end of said rear slide slot in said cutting plate;

a driving unit for activating said driving rod to swing on said base plate; and means for rotating said cutting plate and said swing plate synchronously, forward swinging movement of said rounded end of said driving rod from said rear limit position resulting in movement of said front pivot member from said inclined front portion of said front slide slot in said cutting plate toward said longitudinal rear portion of said front slide slot so as to rotate said cutting plate and said swing plate about said rear pivot member in a first direction until said rounded end of said driving rod moves to a cutter-feeding position, where said front pivot member moves into a front end of said longitudinal rear portion of said front slide slot and where said cutter is located at a stand-by position so as to be adapted to be aligned with the needle, continued forward swinging movement of said rounded end of said driving rod from said cutter-feeding position to said front limit position resulting in forward movement of said cutter in such a manner that said front and rear pivot members move to said rear ends of said front and rear slide slots in said cutting plate, rearward swinging movement of said rounded end of said driving rod from said front limit position to said cutter-feeding position resulting in rearward movement of said cutter back to said stand-by position, continued rearward movement of said rounded end of said driving rod from said cutter-feeding position to said rear limit position resulting in rotation of said cutting plate and said swing plate about said rear pivot member in a second direction that is opposite to said first direction in such a manner that said front pivot member moves from said longitudinal rear portion of said front slide slot in said cutting plate back to said inclined front portion of said front slide slot.

2. The thread cutting device as claimed in claim 1, wherein said means for rotating said cutting plate and said swing plate synchronously includes two flanges that extend respectively and laterally from said cutting plate and said swing plate, each of said flanges being formed integrally on one of said cutting plate and said swing plate and abutting against and pushing the other one of said cutting plate and said swing plate to rotate when said one of said cutting plate and said swing plate rotates about said rear pivot member.

3. The thread cutting device as claimed in claim 1, wherein said base plate has two threaded holes formed therein, each of said front and rear pivot members including an eccentric wheel element that is formed with a threaded hole therethrough, and a bolt that extends threadably and eccentrically through said threaded hole in said eccentric wheel element and into a respective one of said threaded holes in said base plate, said eccentric wheel element of said front pivot member being received rotatably within said front slide slot in said cutting plate and said inclined slide slot in said swing plate, said eccentric wheel element of said rear pivot member being received rotatably within said rear slide slot in said cutting plate and said pivot hole in said swing plate, whereby, said eccentric wheel elements can be rotated on said base plate about said bolts, respectively, so as to be adapted to adjust position of said cutter relative to the needle.

* * * * *